US009849432B2

(12) United States Patent
Fioravanti et al.

(10) Patent No.: US 9,849,432 B2
(45) Date of Patent: Dec. 26, 2017

(54) METHOD FOR PREPARATION OF PHARMACEUTICAL PRODUCTS

(71) Applicant: AESYNT B.V., Amsterdam (NL)

(72) Inventors: Fabio Fioravanti, Trieste (IT); Walter Bianco, Trieste (IT)

(73) Assignee: Aesynt B.V., Amsterdam (NL)

( * ) Notice: Subject to any disclaimer, the term of this patent is extended or adjusted under 35 U.S.C. 154(b) by 0 days.

(21) Appl. No.: 15/169,000

(22) Filed: May 31, 2016

(65) Prior Publication Data

US 2016/0271577 A1 Sep. 22, 2016

Related U.S. Application Data

(63) Continuation of application No. 14/362,980, filed as application No. PCT/IB2012/056998 on Dec. 5, 2012, now abandoned.

(30) Foreign Application Priority Data

Dec. 5, 2011 (EP) ..... 11192020

(51) Int. Cl.
*B01F 15/00* (2006.01)
*A61J 3/00* (2006.01)
(Continued)

(52) U.S. Cl.
CPC ..... *B01F 15/00993* (2013.01); *A61J 3/00* (2013.01); *B01F 7/00708* (2013.01);
(Continued)

(58) Field of Classification Search
CPC ..... B08B 15/023; F24F 3/1607; B01F 2215/0032; B01F 2215/0037
(Continued)

(56) References Cited

U.S. PATENT DOCUMENTS 5,730,777 A * 3/1998 Petersen ..... B25J 21/02 55/310
2009/0061751 A1 3/2009 Polsky
2014/0334247 A1 11/2014 Fioravanti et al.

FOREIGN PATENT DOCUMENTS

EP 11192020.3 12/2011
GB 2286986 9/1995
(Continued)

OTHER PUBLICATIONS

PCT International Search Report and Written Opinion dated Jul. 29, 2013 for PCT/IB2012/056998; 7 pages.
(Continued)

*Primary Examiner* — Tony G Soohoo
*Assistant Examiner* — Elizabeth Insler
(74) *Attorney, Agent, or Firm* — McCarter & English, LLP

(57) ABSTRACT

A method for the preparation of pharmaceutical products is provided that utilizes a machine having a containing liner, a dosing chamber for preparing at least one pharmaceutical product accommodated within the containing liner, and a pneumatic ventilation device for feeding two air flows through the dosing chamber and through the containing liner, respectively. Operation of the pneumatic ventilation device is selectively controlled so that the containing liner has inside a pressure lower than a pressure existing within the dosing chamber and than a pressure existing in the environment outside the containing liner itself.

12 Claims, 5 Drawing Sheets

(51) Int. Cl.

| | |
|---|---|
| ***B01F 7/00*** | (2006.01) |
| ***B08B 15/02*** | (2006.01) |
| ***F24F 3/16*** | (2006.01) |
| ***B01F 15/02*** | (2006.01) |

(52) U.S. Cl.
CPC .. *B01F 15/00162* (2013.01); *B01F 15/00974* (2013.01); *B01F 15/0216* (2013.01); *B08B 15/023* (2013.01); *F24F 3/1607* (2013.01); *B01F 2215/0032* (2013.01)

(58) Field of Classification Search
USPC ..... 366/152.1
See application file for complete search history.

(56) References Cited

FOREIGN PATENT DOCUMENTS

| | | | |
|---|---|---|---|
| JP | H01-118046 | A | 5/1989 |
| JP | H06-319521 | A | 11/1994 |
| JP | 2001-263748 | A | 9/2001 |
| WO | WO 2006/069361 | A2 | 6/2006 |
| WO | WO 2008/012596 | A2 | 1/2008 |
| WO | PCT/IB2012/056998 | | 12/2012 |

OTHER PUBLICATIONS

Japanese Office Action dated Jun. 21, 2016 from corresponding Japanese Application 2014-545426.

* cited by examiner

METHOD FOR PREPARATION OF PHARMACEUTICAL PRODUCTS

CROSS-REFERENCE TO RELATED APPLICATIONS

This application is a continuation patent application that claims priority benefit to a co-pending non-provisional patent application entitled "Machine for the Preparation of Pharmaceutical Products," which was filed on Jun. 5, 2014, and assigned Ser. No. 14/362,980, which in turn claims the benefit of PCT/IB2012/056998, which was filed on Dec. 5, 2012, which in turn claims the benefit of European Application No. 11192020.3, which was filed on Dec. 5, 2011, all of which are herein incorporated by reference in their entireties.

TECHNICAL FIELD

The present invention relates to a machine for the preparation of pharmaceutical products.

BACKGROUND ART

A machine is known in the field of the preparation of pharmaceutical products, in particular of the preparation of toxic pharmaceutical products, such as, for example, cytostatic drugs used for chemotherapy, comprising a store for a plurality of containers, e.g. infusion bags, bottles and syringes; a dosing station for the preparation of a pharmaceutical product obtained by mixing, by means of a syringe, at least one pharmaceutical substance contained in a bottle and at least one diluent contained in an infusion bag; a weighing station of the containers; and a robotized arm for gripping and transporting the containers themselves.

The store, the dosing station, the weighing station and the robotized arm are accommodated within a containment chamber limited by a protective casing provided with an access opening adapted to allow personnel to load and/or unload the various types of containers into/from the store itself.

In order to protect the health of personnel and to avoid the diffusion of toxic substances outside the containing chamber, the machine normally comprises a pneumatic ventilation device for feeding an air flow through the containing chamber itself.

The pneumatic ventilation device is selectively controlled so that the pressure existing in the containing chamber is lower than the pressure existing in the environment outside the containing chamber itself.

The known machines for the preparation of pharmaceutical products of the type described above have some drawbacks mainly deriving from the fact that the various pressures existing in the containing chamber and in the environment outside the containing chamber prevent the diffusion of toxic substances from the containing chamber into the outside environment, but do not prevent the diffusion of contaminating agents from the outside environment into the containing chamber.

DISCLOSURE OF INVENTION

It is an object of the present invention to provide a machine for the preparation of pharmaceutical products which is free from the above-described drawbacks, and which can be simply and cost-effectively implemented.

According to the present invention, a machine for the preparation of pharmaceutical products is provided as claimed in the appended claims.

BRIEF DESCRIPTION OF THE DRAWINGS

The present invention will now be described with reference to the accompanying drawings, which show a non-limitative embodiment thereof, in which.

BEST MODE FOR CARRYING OUT THE INVENTION

Figure 1:
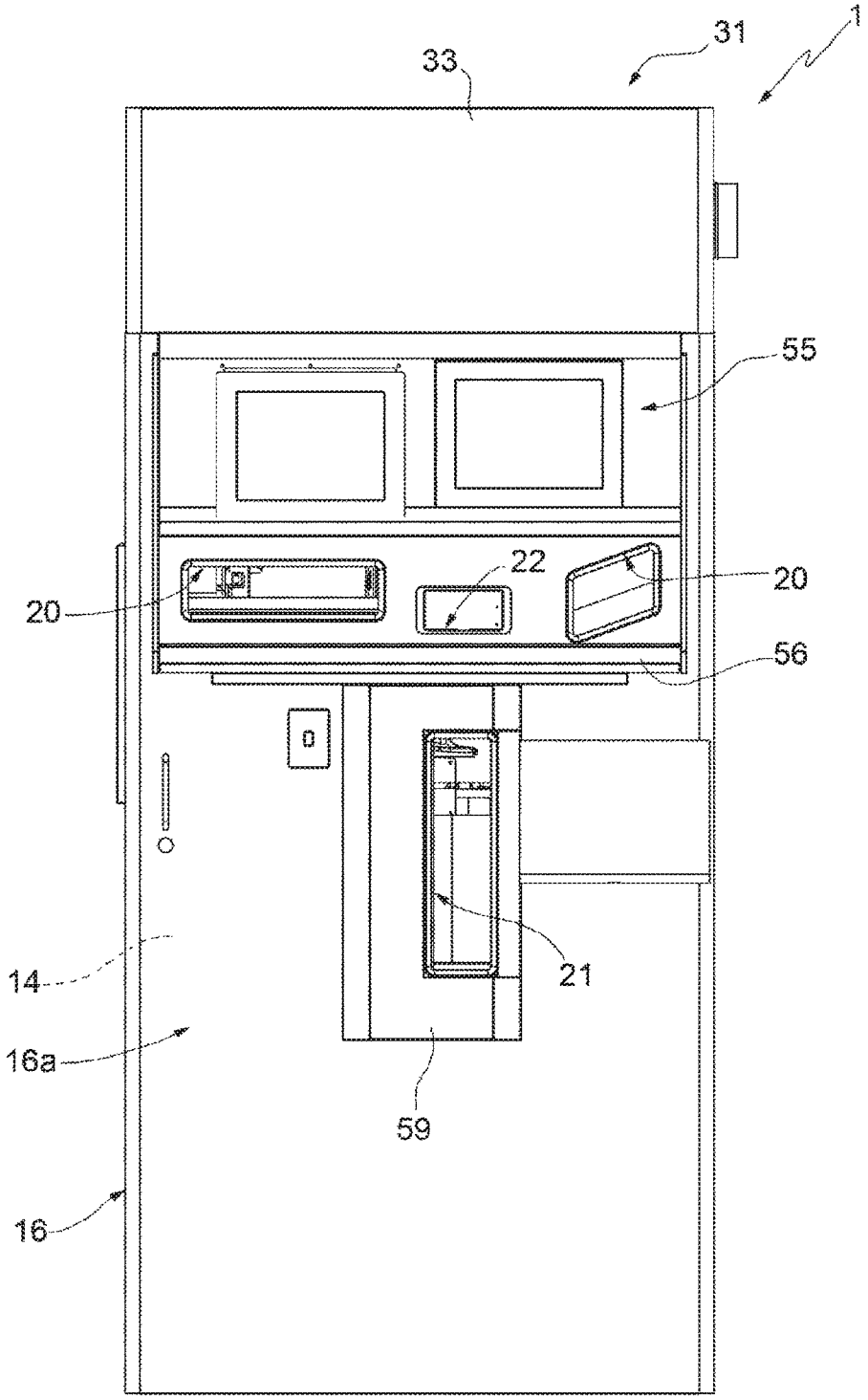
FIG. 1 is a diagrammatic front view, with parts removed for clarity, of a preferred embodiment of the machine according to the present invention.

With reference to FIGS. 1, 2, 3 and 4, reference numeral 1 indicates as a whole a machine for the preparation of pharmaceutical products comprising a dosing chamber 2 limited, in the case in point, by a front wall 3 and by a rear wall 4, substantially vertical and parallel to each other, by two substantially vertical side walls 5, perpendicular to the walls 3 and 4, by a substantially horizontal bottom wall 6, and by a substantially horizontal upper wall 7, parallel to the wall 6 itself.

Chamber 2 accommodates therein a pocket drum 8 for storing infusion bags (not shown); a robotized gripping and transporting device 9, which is fitted in the drum 8, comprises a plurality of articulated arms 10 hinged to each other, and is provided with a gripping member 11 fitted on the free end of the arms 10; a weighing device 12 of the infusion bags (not shown); and a dosing station 13 for the preparation of a pharmaceutical product.

Furthermore, the machine 1 has a store 14, which allows the storage of a plurality of containers 15 (in the case in point, bottles and syringes which can also be weighed on the device 12), and comprises a parallelepiped-shaped box-like body 16 coupled to the front wall 3 so as to protrude downwards from chamber 2.

Figure 2:
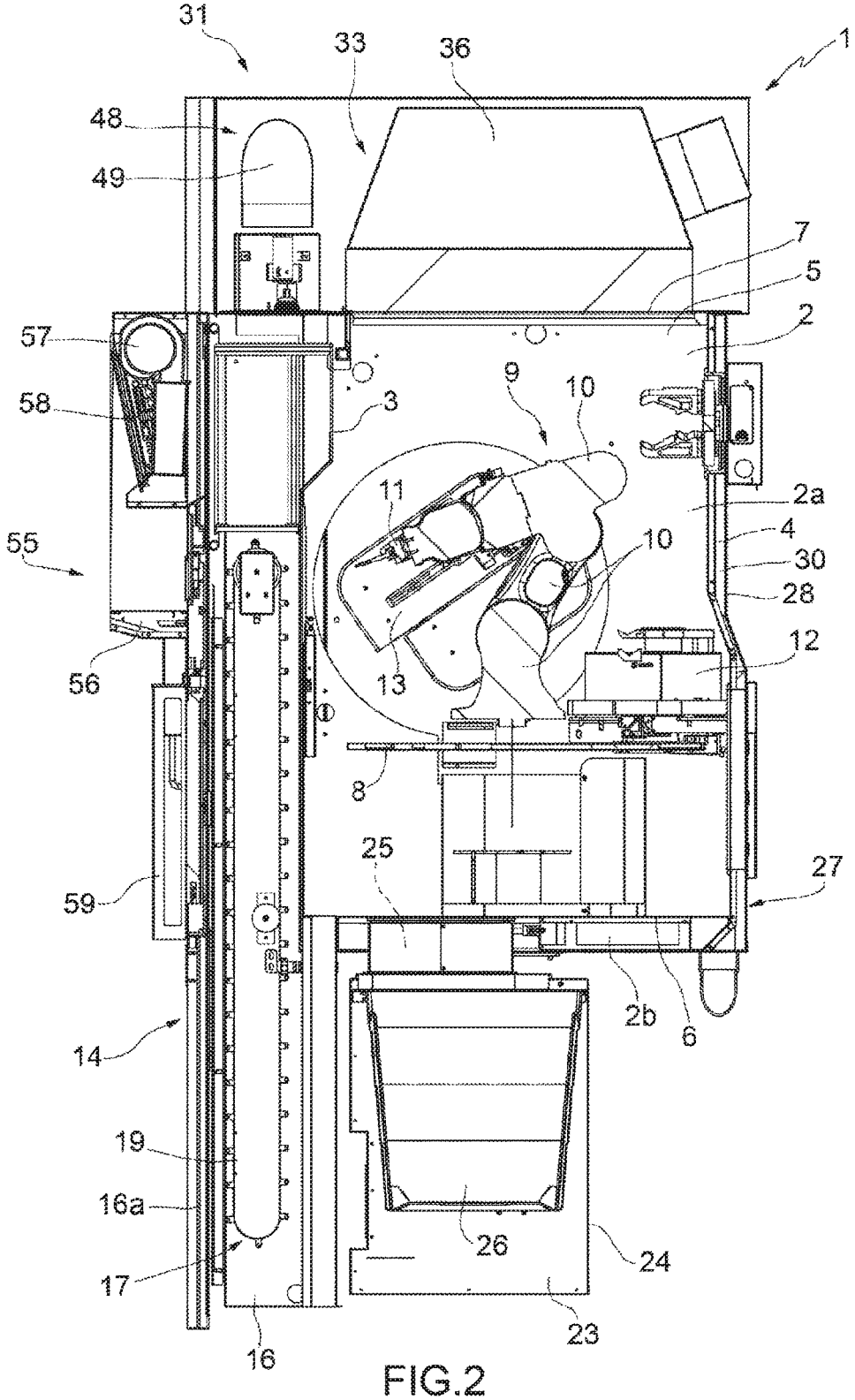
FIG. 2 is a diagrammatic side view, with parts in section and parts removed for clarity, of the machine in FIG. 1.
Figure 3:
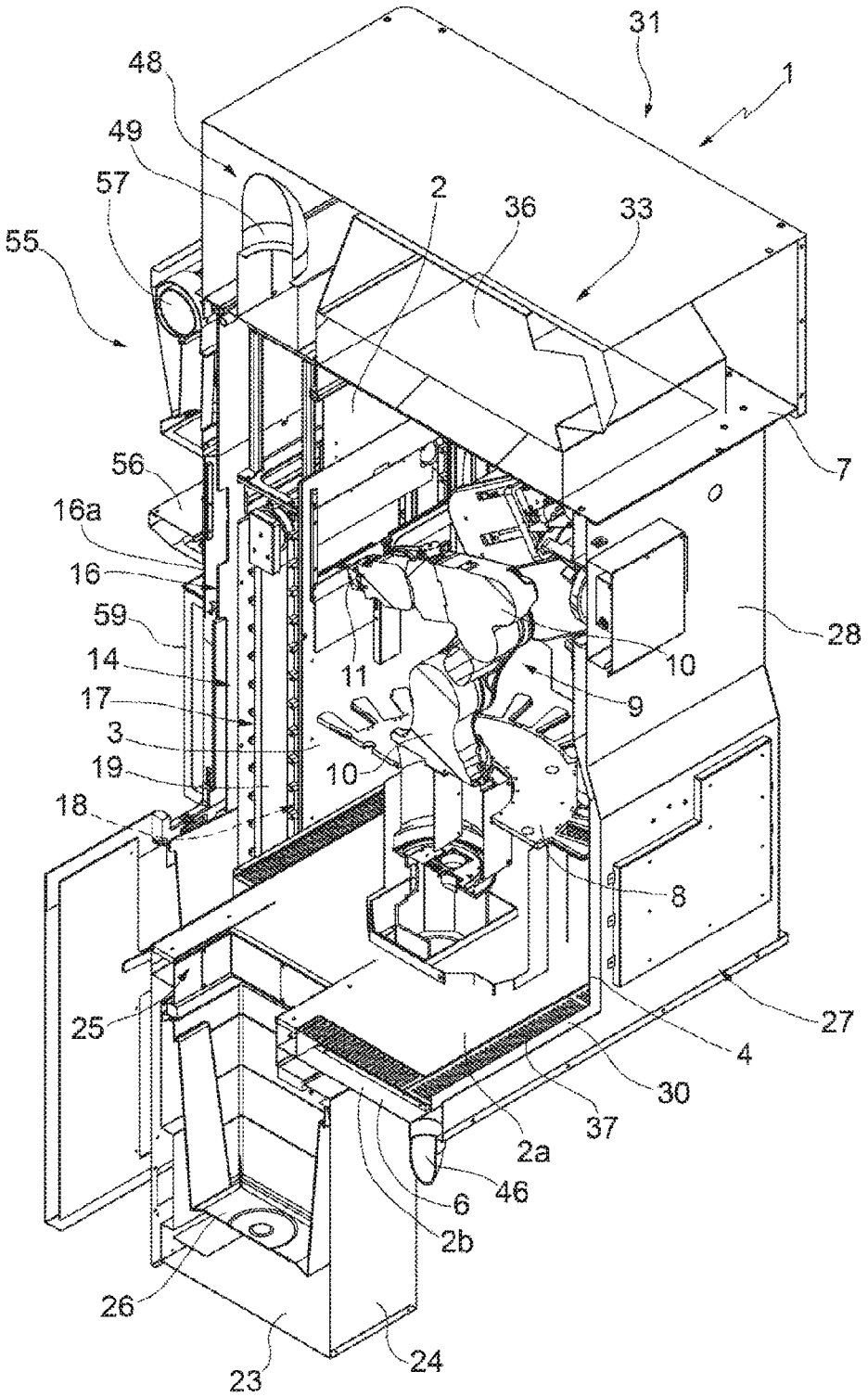
FIG. 3 is a diagrammatic perspective view, with parts in section and parts removed for clarity, of the machine in FIG. 1.
Figure 4:
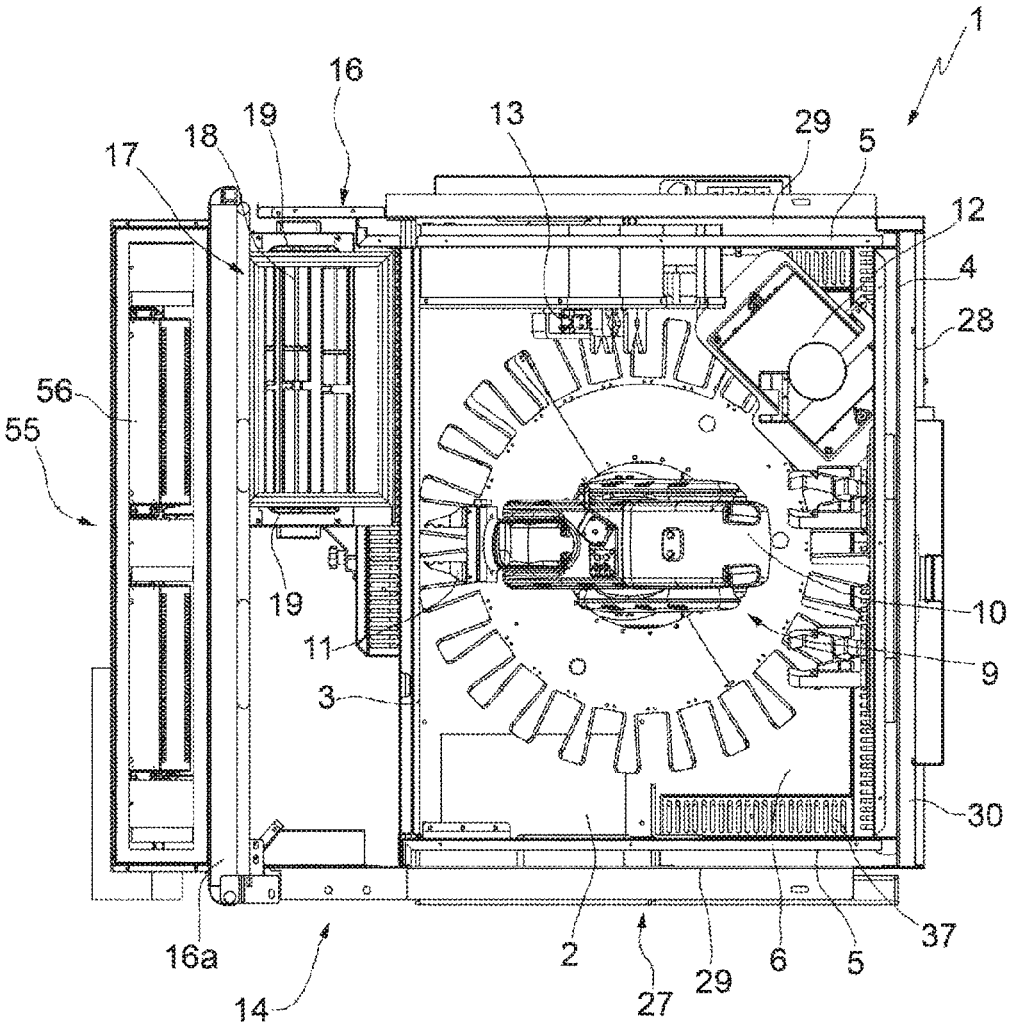
FIG. 4 is a diagrammatic plan view, with parts in section and parts removed for clarity, of the machine in FIG. 1.
Figure 5:
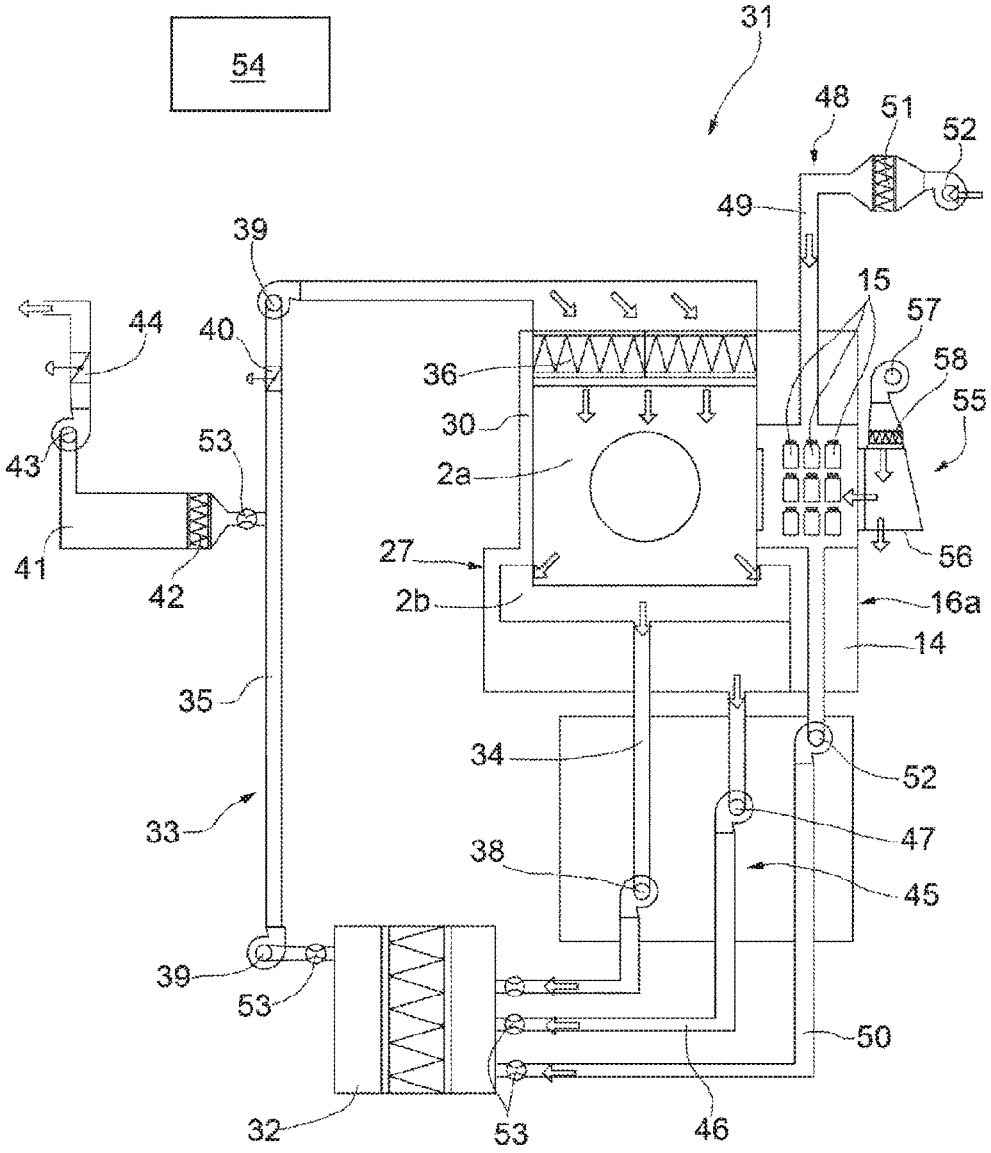
FIG. 5 diagrammatically shows the operation of a pneumatic ventilation device fitted in the machine in FIG. 1.

Store 14 accommodates therein two pocket conveyor devices 17 (only one of which is shown in FIGS. 2 and 3), each of which is shaped to store a given type of container 15, and has a plurality of pockets 18 fitted between a pair of belt conveyors 19.

The containers 15 of each device 17 are loaded into and/or taken from the respective pocket 18 through a first opening 20 obtained through a front wall 16*a* of body 16 and normally closed by a first access door (not shown) and through a second opening (not shown) obtained through the wall 3 and normally closed by a second access door (not shown).

The mentioned infusion bags (not shown) are transferred to and from the drum 8 by means of a linear conveyor (known and not shown), which is engaged in sliding manner by an adapter member fitted on each infusion bag (not shown), communicates with the environment outside the machine 1 through an opening 21 obtained through the wall 16*a* and normally closed by an access door (not shown), and further communicates with chamber 2 through an opening (not shown) obtained through the wall 3 and normally closed by an access door (not shown).

Furthermore, store 14 comprises a vibration distribution plate (not shown) for a plurality of closing caps (not shown) of the mentioned syringes (not shown).

The vibrating distribution plate (not shown) is accommodated within body 16, is loaded by the personnel with closing caps (not shown) through an opening 22 obtained through the wall 16*a* and normally closed by an access door (not shown), and communicates with chamber 2 by means of an opening (not shown) obtained through the wall 3 and normally closed by an access door (not shown).

Furthermore, the machine 1 comprises a chamber 23 for collecting the machining waste of the machine 1 itself.

Chamber 23 is obtained under chamber 2, is limited by a box-like body 24 fitted under the wall 6, and communicates with chamber 2 through an opening 25 obtained through the wall 6 and normally closed by an access door (not shown).

Chamber 23 accommodates therein a container 26 for collecting the machining waste of the machine 1 adapted to be extracted from chamber 23 through a hatch (not shown) defining part of the body 24 after having been closed and sealed automatically with a lid (not shown) within chamber 23 itself.

Store 14 and therefore body 16 jointly define with chamber 23, and thus with the body 24, part of a containing liner 27 of chamber 2.

The liner 27 further comprises a rear wall 28 substantially superimposed on the wall 4 and two side walls 29 substantially superimposed on walls 5.

The walls 4, 28 and the walls 5, 29 mutually define a gap 30 closed at the bottom by wall 6 and at the top by wall 7.

The machine 1 is provided with a pneumatic ventilation device 31 comprising a main filtering unit 32 and a first feeding circuit 33 for feeding an air flow through chamber 2.

Circuit 33 comprises an inlet branch 34 for feeding the air from chamber 2 into the unit 32, and an outlet branch 35 for feeding the air from the unit 32 firstly through a secondary filtering unit 36 fitted over the wall 7, and thus into chamber 2.

In this regard, it is worth noting that the bottom wall 6 of chamber 2 is shaped as a double wall adapted to divide chamber 2 itself into an upper chamber 2*a* and a lower chamber 2*b* connected to each other by means of a peripheral intake grille 37 which facilitates the direction of the air flow from chamber 2*a* to chamber 2*b*.

Circuit 33 is further provided with a variable flow rate impeller 38 arranged along the branch 34, two adjustable flow rate impellers 39 arranged along the branch 35, and an on-off valve 40 arranged along the branch 35 between the two impellers 39.

The device 31 further comprises a discharge pipe 41 of at least part of the air from the unit 32 into the outside environment.

The pipe 41 is connected to the branch 35 between the two impellers 39 and upstream of the valve 40 in a direction of advancement of the air along the branch 35, and has a filtering unit 42, an adjustable flow rate impeller 43, and a flow rate adjustment valve 44 arranged in sequence and in order along the pipe 41 itself.

The device 31 further comprises a second feeding circuit 45 for aspirating an air flow from chamber 23 and from gap 30.

Circuit 45 comprises an inlet branch 46 for feeding air from liner 27 into unit 32, and an adjustable flow rate impeller 47 fitted along the branch itself 46.

Furthermore, the device 31 has a feeding circuit 48 for feeding an air flow through store 14 and thus body 16.

The circuit 48 comprises an inlet branch 49 for feeding air from the outside environment into body 16, an outlet branch 50 for feeding air from body 16 into the unit 32, a filtering unit 51 fitted along the branch 49, and two adjustable flow rate impellers 52 fitted along branch 49 and branch 50, respectively.

Furthermore, each branch 34, 35, 46, 50 is provided, similarly as, the pipe 41, with a device 53 for measuring the air flow rate fed along the branch 34, 35, 46, 50 or along the pipe 41.

The operation of the impellers 38, 39, 47, 52, and thus the air flow feed through chamber 2 and store 14 and the air flow aspirated through the gap 30, are selectively controlled by means of an electronic control unit 54 as a function of the signals coming from the devices 53 and by further measuring devices (not shown) of the pressures existing within chamber 2, store 14, gap 30, and the outside environment so that the pressure within the liner 27 is lower than the pressure within chamber 2 and the pressure in the outside environment and the pressure in chamber 2 is higher than the pressure in the outside environment.

In other words, the pressure within the liner 27 on one hand allows the possible diffusion of toxic substances from chamber 2 into liner 27 but prevents the diffusion thereof from liner 27 into the outside environment, and on the other hand allows the possible diffusion of contaminants from the outside environment into liner 27 but prevents the possible diffusion from liner 27 into chamber 2.

From the above, it derives that the toxic substances present inside chamber 2 cannot jeopardize the health of personnel and that the contaminants present in the outside environment cannot compromise the correct preparation of the pharmaceutical products in chamber 2 itself.

When the front wall 3 of chamber 2 is opened to allow cleaning and/or maintenance operations of chamber 2 itself, the on-off valve 40 fitted along the branch 35 is closed, and the impeller 43 is activated to discharge the air fed along branch 35 into the outside environment and make the pressure in chamber 2 substantially equal to the pressure in liner 27 and lower than the pressure in the outside environment.

When one of the access doors (not shown) obtained through front wall 3 of chamber 2 is opened to allow the robotized device 9 to load/unload containers 15 or the mentioned closing caps (not shown) of the syringes to/from store 14, the pressure in chamber 2, being higher than the pressure in body 16, diverts part of the air flow fed along the branch 35 from chamber 2 into body 16 itself. As the mentioned access doors are mainly arranged at an upper zone of chamber 2, the air diverted from chamber 2 into body 16 thus comes from the filtering unit 36 without coming into contact with the possible contamination zones.

When the access door (not shown) obtained through the front wall 3 of chamber 2 is opened to allow the introduction/removal of the infusion bags into/from chamber 2, the pressure in chamber 2, being higher than the pressure in body 16, diverts part of the air flow fed through chamber 2 in body 16 itself. As the mentioned access door (not shown) is arranged at a lower zone of chamber 2 and between the two conveyor devices 17 of containers 15, the air diverted from chamber 2 in body 16 is thus immediately taken from branch 50 of the feeding circuit 48 without coming into contact with containers 15.

When one of the access doors (not shown) obtained in the wall 16*a* is opened to load/unload containers 15 or the mentioned infusion bags (not shown) or the mentioned closing caps (not shown) of the syringes into/from store 14, the entrance of contaminants present in the outside environment into store 14 is obstructed by a feeding flow 55, which feeds an air flow along the wall 16*a*, and defines part of the device 31.

Circuit 55 comprises a shelf 56 fitted underneath the openings 20 and 22, and an adjustable flow rate impeller 57 fitted over the openings 20 and 22 for feeding an air flow taken from the outside environment firstly through a filtering unit 58 and thus to shelf 56.

The air flow generated by the impeller 57 is fed to shelf 56 in substantially vertical direction, and thus taken in by a frame 59 fitted about opening 21, diverted by frame 59 in substantially horizontal direction, fed on opening 21, and finally discharged downwards again into the outside environment.

As the pressure in body 16 is lower than the pressure in the environment outside the machine 1, the air flow fed along the wall 16*a* defines, on one hand, an air barrier adapted to obstruct the introduction of contaminants inside store 14, and on the other is diverted in part inside store 14 through the access door (not shown) opened each time.

Consequently, the activation of circuit 55 obstructs the introduction of air coming from the outside environment into body 16 allowing the introduction into body 16 of filtered air coming from unit 58.

According to some variants (not shown):

feeding circuit 45 is eliminated and replaced with a feeding circuit similar to circuit 33 and adapted to feed an air flow through the gap 30;

containing liner 27 is shaped so as to fully envelop dosing chamber 2 at the front wall 3, the rear wall 4 and the side walls 5, both at the bottom wall 6 and the upper wall 7.

The invention claimed is:

1. A method for preparation of pharmaceutical products, the method comprising:

a) providing a machine (1) for preparing at least one pharmaceutical product via at least one dosing chamber (2) provided with a mixing assembly (13) and a pneumatic ventilation device (31), wherein the machine (1) further comprises a containing liner (27) that extends about the dosing chamber (2) so as to define a first containing chamber (23, 30) and a second containing chamber (16) for a store (14) for a plurality of containers (15) containing at least one of pharmaceutical product and diluents therein;

b) generating air flow via the pneumatic ventilation device (31), wherein a first air flow is directed into the dosing chamber (2) and at least one second air flow is directed into the containing liner (27);

c) selectively controlling the pneumatic ventilation device (31) with a control unit (54), wherein said control unit (54) controls the pneumatic ventilation device (31) so as to control the first and second air flows, so that the containing liner (27) has inside a pressure lower than a pressure existing within the dosing chamber (2) and a pressure lower than a pressure existing in the environment outside the containing liner (27) itself;

d) feeding the first air flow through the dosing chamber (2) via a first feeding circuit (33);

e) aspirating the second air flow from the first containing chamber (23, 30) via a second feeding circuit (45);

f) feeding a third air flow through the second containing chamber (16) via a third feeding circuit (48);

g) providing a loading station (56) of the containers (15) into the store (14) and at least one communication door for connecting the store (14) and the environment outside the containing liner (27) to each other; and h) feeding a fourth air flow from the pneumatic ventilation device (31) along and external to said at least one communication door via a fourth feeding circuit (55), wherein said fourth air flow is external to the containing liner (27) and obstructs introduction of air from the environment outside the containing liner (27).

2. The method as recited in claim 1, wherein the control unit (54) is effective to control the pressure existing in the dosing chamber (2) at a higher level than the pressure existing in the environment outside the containing liner (27).

3. The method as recited in claim 1, wherein the pneumatic ventilation device (31) further comprises, for each said feeding circuits (33, 45, 48), at least one respective impeller (38, 39, 47, 52) for feeding the respective air flow along the feeding circuit (33, 45, 48) itself.

4. The method as recited in claim 3, wherein for each said impeller (38, 39, 47, 52), a respective adjustment valve (44) for selectively controlling the air flow fed by the impeller (38, 39, 47, 52) itself along the respective feeding circuit (33, 45, 48).

5. The method as recited in claim 1, wherein said control unit (54) measures the air flow fed along the feeding circuit (33, 45, 48) itself.

6. The method as recited in claim 1, wherein the pneumatic ventilation device (31) further comprises a first filtering unit (32); each of said feeding circuits (33, 45, 48) comprising an inlet branch (34, 46, 50) of the respective air flow in the first filtering unit (32).

7. The method as recited in claim 6, wherein the first feeding circuit (33) further comprises an outlet branch (35) of the respective air flow from the first filtering unit (32); the pneumatic ventilation device (31) further comprising a second filtering unit (36) arranged along the outlet branch (35) itself.

8. The method as recited in claim 7, wherein the outlet branch (35) is connected to the dosing chamber (2) for feeding air coming from the first filtering unit (32) to the dosing chamber (2), is further connected to the discharge pipe (41) for discharging at least part of the air coming from the first filtering unit (32) into the external environment, and is provided with an on-off valve (40) fitted along the outlet branch (35) downstream of the discharge pipe (41).

9. The method as recited in claim 8, wherein the pneumatic ventilation device (31) comprises a third filtering unit (42) arranged along said discharge pipe (41).

10. The method as recited in claim 1, wherein said control unit (54) measures the pressure in the dosing chamber (2), the pressure in the containing liner (27) and the pressure in the outside environment.

11. The method as recited in claim 1, wherein the pressure within the containing liner (27) allows for the possible diffusion of substances from dosing chamber (2) into containing liner (27) but prevents the diffusion thereof from containing liner (27) into the outside environment.

12. The method as recited in claim 1, wherein the pressure within containing liner (27) allows for the possible diffusion of substances from the outside environment into containing liner (27) but prevents the possible diffusion from containing liner (27) into dosing chamber (2).

* * * * *